US007024838B2

(12) United States Patent
Freemantle

(10) Patent No.: US 7,024,838 B2
(45) Date of Patent: Apr. 11, 2006

(54) PACKAGING APPARATUS

(75) Inventor: Tony Freemantle, Scunthorpe (GB)

(73) Assignee: T. Freemantle Ltd, Scunthorpe (GB)

( * ) Notice: Subject to any disclaimer, the term of this patent is extended or adjusted under 35 U.S.C. 154(b) by 0 days.

(21) Appl. No.: 10/387,939

(22) Filed: Mar. 13, 2003

(65) Prior Publication Data

US 2003/0230057 A1 Dec. 18, 2003

(30) Foreign Application Priority Data

Mar. 15, 2002 (GB) ..... 0206151

(51) Int. Cl.
*B65B 43/24* (2006.01)

(52) U.S. Cl. ..... 53/566; 53/564; 53/169; 53/250; 53/381.1; 53/389.1

(58) Field of Classification Search ..... 53/169, 53/250, 381.1, 389.1, 564, 566; 493/180, 493/181, 182, 183, 319
See application file for complete search history.

(56) References Cited

U.S. PATENT DOCUMENTS 2,832,181 A * 4/1958 Engleson et al. ..... 53/566
2,900,880 A 8/1959 Engleson et al. ..... 93/53
2,956,483 A * 10/1960 Hartbauer ..... 493/319
3,111,066 A * 11/1963 Birch-Iensen et al. ..... 493/181
3,613,527 A 10/1971 Hentges
3,881,298 A * 5/1975 Griner et al. ..... 53/566
4,109,444 A * 8/1978 Lee ..... 53/566
4,358,918 A * 11/1982 Groom et al. ..... 53/566
4,386,923 A * 6/1983 Okushita ..... 493/183
4,562,692 A * 1/1986 Scarpa et al. ..... 53/566
5,081,816 A * 1/1992 Cardinali ..... 53/566
5,473,868 A * 12/1995 Antonio ..... 53/566
5,562,581 A * 10/1996 Roberto et al. ..... 53/566
5,588,276 A 12/1996 Terjung et al.

FOREIGN PATENT DOCUMENTS

EP 0148345 A2 7/1985
JP 11277643 A 12/1999

* cited by examiner

*Primary Examiner*—Louis Huynh
(74) *Attorney, Agent, or Firm*—Head, Johnson & Kachigian

(57) ABSTRACT

An apparatus for forming packages of pre-cooked meals. The package comprises a tray enclosed at least partially by a card sleeve having top and bottom faces and two opposing side walls. The forming apparatus includes a series of forming tools mounted for movement at spaced intervals and each forming tool is provided for the reception of a sleeve in a blank flattened form. As the sleeve is introduced into the forming tool the sleeve is moved to the erected condition, the tray is inserted in the erected sleeve and the formed package removed from the forming tool.

11 Claims, 7 Drawing Sheets

PACKAGING APPARATUS

CROSS-REFERENCE TO RELATED APPLICATION

This is an United States Application entitled "Packaging Apparatus" claiming priority to British Application No. 0206151.3 filed 15 Mar. 2002.

BACKGROUND OF THE INVENTION

The invention to which this application relates is apparatus and a method for erecting a packaging sleeve from a blank, folded substantially flat condition to an in-use condition for subsequent insertion of an article, most typically a tray, therein to form a package.

Reference hereonin is made to the insertion of an article in the form of a tray but this reference does not limit the invention for use solely with a tray. In addition reference to a sleeve incorporates many different designs of sleeve, examples of which are provided herein in a non-limiting manner.

Particularly, although not necessarily exclusively, the sleeve is what is known as a 5-fold sleeve formed from card and having a top face, bottom face, and two opposed side walls joining said top and bottom faces and with one of the side walls having an intermediate elongate fold line. The sleeve, when erected, defines a passage with an opening at each end thereof into which a tray can be inserted. Typically, two of the fold lines define the corners between the front face and side walls, two fold lines define the corners between the side walls and the bottom face, with the fifth fold line located intermediate the corner fold lines of one of the side walls. When provided in the folded or blank condition as referred to herein, the free ends of the sleeve are already joined together, typically by gluing, in an overlapping manner, said join typically but not always, positioned at or adjacent one of the side walls.

Typically, the packages are provided as retail packs, provided to hold a foodstuff such as a frozen or chilled foodstuff for purchase in a retail outlet and subsequently, by removal of the sleeve, and typically an enclosing film, the foodstuff can be eaten or first cooked in the tray at home.

Large numbers of said packages are sold on a daily basis and conventionally the packages are formed manually or automatically using appropriate machinery. In each case there is a significant problem in terms of the relatively slow throughput of the packages due to the package forming process and apparatus, if any. If a manual process is used, the sleeve is moved from a blank to an erected form by hand and the tray inserted into the sleeve passage through one of the openings. In an automatic process the sleeve is moved from a blank to an erected form by the provision of mechanical fingers which locate on the bottom face of the blank and pull the same downwards and away from the top face and so move the sleeve into a former into which the tray can then be inserted either manually or by automatic pushers. In one embodiment, the fingers include suction means such as vacuum pads to locate and move the sleeve.

Thus, if the process is performed manually, the same is intensive in terms of personnel and, if performed automatically, the process is slow due to the fact that no continuous forming operation occurs. Other automated package forming apparatus is known but tends to relate to the erection of boxes from blanks rather than sleeve blanks and, as such, is not applicable or usable in practical terms as is evidenced by the conventional apparatus and methods currently used for sleeves. One box blank erecting apparatus is disclosed in U.S. Pat. No. 2,900,880 where a box with right angled side faces with respect to the front and bottom faces is formed.

SUMMARY OF THE INVENTION

The aim of the present invention is to provide a package forming apparatus and forming tool for use therewith, which allows the formation of a package comprising an erected sleeve with an article placed therein and to allow the package to be formed efficiently and reliably while also improving the speed and throughput of the same.

In a first aspect of the invention there is provided apparatus for the formation of a package, said package comprising a sleeve having at least top and bottom faces and opposing side walls, and an article which is inserted in the sleeve when in an erected condition to form the package, said sleeve movable between blank and erected conditions and characterised in that said apparatus includes placement means to move a sleeve in a blank condition for placement into a forming tool and said sleeve is moved to the erected condition by insertion of the same into the forming tool, said forming tool mounted for movement on drive means along a path, and once erected, the article is inserted into the sleeve.

Typically the formation of the package as described is repeated for successive sleeve blanks as they are removed from a store magazine and the articles are a series of trays including foodstuffs therein and which foodstuffs may be sealed in the tray.

In a preferred embodiment the sleeve blanks are moved from the store to be positioned in the forming tool by rotation of the placement means. Typically in the movement the sleeve rotates about at least 180 degrees but more typically at least 240 degrees.

Typically the forming tools are mounted in a spaced manner along a drive means, said drive means having a forward path during which the blanks are erected, the article inserted and the package removed, and a return path by which the forming tools are returned to a start position for the reception of a new sleeve blank.

In one embodiment the drive means has a linear forward path and a return path.

Preferably, a number of said forming tools are located at spaced intervals on the drive means for linear movement. Typically, upon the removal of the formed package, each forming tool is moved to a start position to repeat the forming operation for the next sleeve blank inserted therein, and so on, thus providing a continuous package forming apparatus.

Typically, the sleeve blanks are held in a store magazine for feeding to the rotational placement apparatus which presents each blank in turn for insertion into a respective forming tool, as it passes the location for the presentation of the blank by the placement tool.

Typically, the drive mechanisms for the rotational placement apparatus and the forming tool drive means are mechanically linked so as to be synchronised, thereby ensuring that each sleeve blank is inserted into a respective forming tool in the required position and path as the forming tools move. It is preferred that the forming tools move continuously or at least move continuously in the vicinity of the placement means as the relative movement between the placement means in a first direction and the forming tool cause the commencement of erection of the sleeve blank.

Typically, the sleeve blank is inserted into the forming tool with the intermediate fold line folded to lie outwardly of the blank such that the side surface with the intermediate fold line first contacts with the forming tool.

In one embodiment, erection fingers and/or a bar are provided to further assist the erection of the sleeve blank, and retain the sleeve in the forming tool. In one embodiment said fingers may make first contact with the blank prior to the forming tool.

In order to aid the removal of the formed package from the forming tool, removal means may be provided to locate with the formed package and to carry the same away from the forming tool at the end of the package forming path. In a preferred embodiment, at least one, but preferably two, driven removal belts are provided and positioned with respect to the forming tool such that as the package in the tool reaches the belts, the belts contact and support the moving package in a first direction as the forming tool turns on the drive means to commence its return path. The formed packages can then be moved to a packing or storage location by the drive belts. Further removal means in the form of mechanical fingers may also be provided.

Typically the forming tool includes a base, and first and second opposing side walls, said side walls lying perpendicular to the direction of travel of the forming tools on the drive means. In one embodiment the rear side wall, as the forming tool is moving along the forward path, is first contacted by the sleeve blank from the placement means and, yet further by the side wall of the blank which includes the intermediate fold line.

Typically the rear side wall can be formed to suit particular sleeve forming requirements and can include any or any combination of an angled portion and/or vertical portion, and/or a lip at the free edge of the said side wall.

Typically the forming tool can be attached to the drive means by releasable location means mounted on a plate, said plate having location means for location with respect to the drive means plate and wherein one of the location means is slotted for location on a peg by movement of the plate in a first direction, and the second location means is slotted so as to allow location on a second peg by movement in a second direction by rotation about the first peg. Typically the second peg is provided to receive locking means so as to retain the forming tool in location.

Typically the forming tools are provided in sets, each set provided to allow the formation of a particular sleeve design.

In one embodiment the article inserted into the erected sleeve is a tray, said tray, with foodstuffs therein, moved into the sleeve while the sleeve is retained in the forming tool. In one embodiment the tray is manually inserted. Alternatively and preferably, automatic feed means are provided to allow the trays to be moved to be inserted into the erected sleeves in a direction perpendicular to the movement of the forming tools along the drive means. Preferably the insertion occurs as the forming tools continue to move along the forward path of the drive means and yet further the movement means for the tray are synchronised with the movement of the forming tools on the drive means.

In a further aspect of the invention there is provided apparatus for the formation of a package, said package comprising a sleeve having at least top and bottom faces and opposing side walls, and an article which is positioned in the sleeve when in an erected condition to form the package, said sleeve movable between blank and erected conditions and characterised in that said apparatus includes a store of sleeves in a blank form, placement means to select and move a sleeve from the store for placement into a forming tool, said forming tool mounted for movement along a path and said blank retained by the placement tool as contact is made with the forming tool with relative movement between the forming tool and placement means to at least partially erect the sleeve whereupon the sleeve is released by the placement means and positioned in an erect form in the forming tool whereupon the tray is placed to lie within the sleeve and the formed package removed from the forming tool.

In accordance with a further aspect of the invention there is provided a forming tool, said tool provided to allow the movement of a sleeve from a blank to an erected form therein, said forming tool having a mounting plate, a base and opposing side walls.

Typically, at least one of the side walls has at its upper edge, a lip portion, said lip portion acting as a locating and limiting means for movement of one of the side walls of the sleeve in a direction away from the forming tool and thereby serving to locate the sleeve blank in position during and after formation. Typically, the side wall which has the lip portion is the same side wall which is first contacted by the sleeve blank as it is introduced into the forming tool.

In one embodiment, the side walls of the forming tool are angled to match the angles at which the sleeve blank side walls are to lie when erected. The forming tool can either be adjustable to allow parts of the same to be adjusted to suit the particular design of the sleeve to be formed therein or, alternatively, the forming tools are removable from the drive means to allow the appropriately shaped forming tools to be positioned on the drive means to suit the sleeve to be formed at that time. Thus it will be appreciated that any one forming apparatus can be provided to be used with as many sets of forming tools as required to allow the apparatus to be used to form the sleeve blanks of different design.

Preferably the width of the forming tool is less than the width of the package so as to be narrower and allow end portions of the sleeve or tray to protrude. These ends can, if required, be picked up on removal means such as a set of belts to remove the formed package from the tool.

DESCRIPTION OF THE DRAWINGS

A specific embodiment of the invention is now described with reference to the accompanying drawings, wherein.

DESCRIPTION OF THE PREFERRED EMBODIMENTS

Referring firstly to FIG. 1A-E, there are illustrated several embodiments of a package 2 formed in accordance with the invention. The package, in each case, comprises a tray 4 retained at least partially within a sleeve in an erected form 6.

Figure 3:
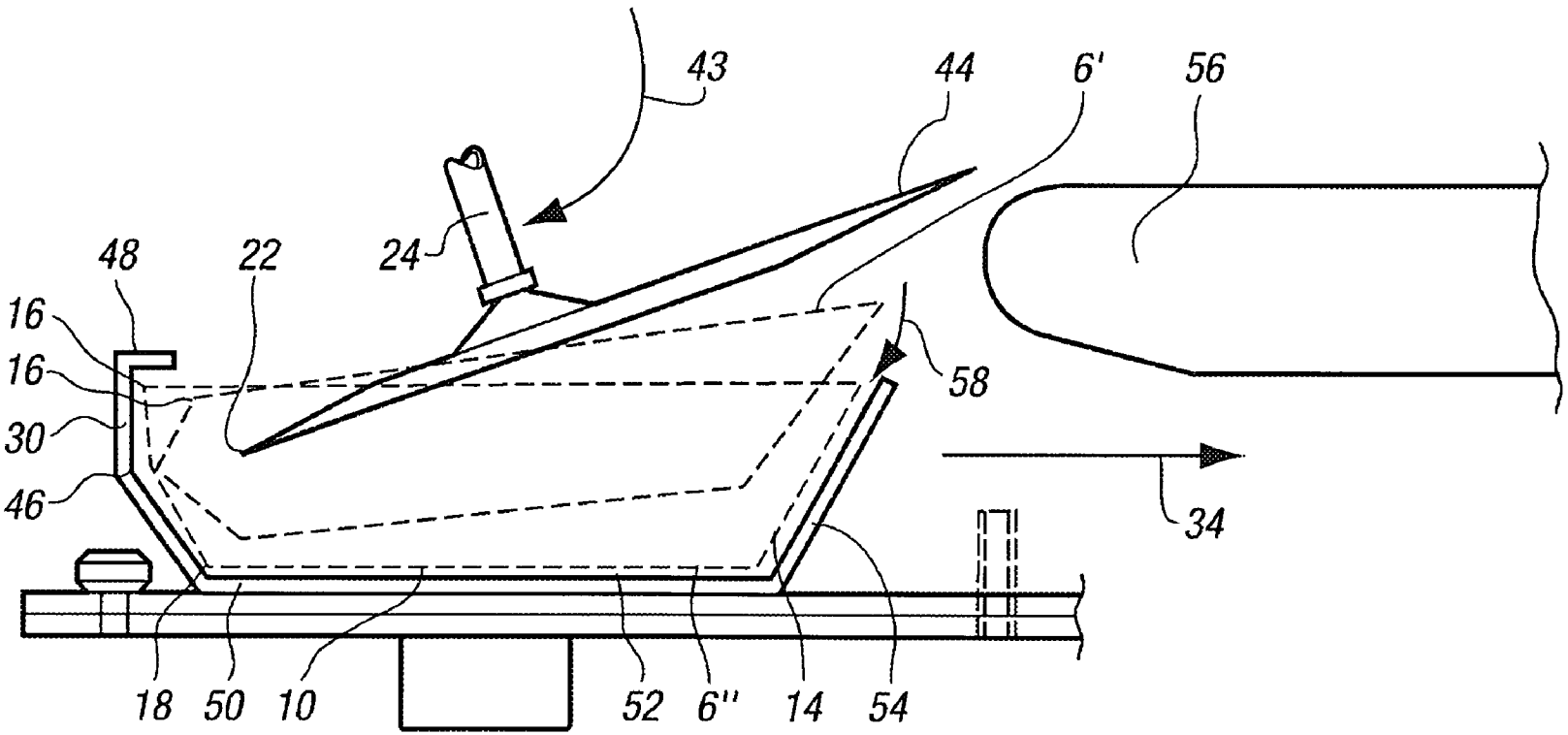
FIG. 3 illustrates a detailed view of one sleeve being formed in accordance with the invention.

The sleeve, when erected, comprises a top face 8, bottom face 10 and two side walls 12, 14 which are opposing and which join the top and bottom faces 8, 10. A series of fold lines are provided and located such that fold lines 15, 16 define the corners between the top face and side walls, fold lines 18 and 20 define the corners between the bottom face and side walls and fold line 22 is located intermediate the edges of one of the side walls 12, 14 as shown. The fold line 22 is provided to aid the formation of the sleeve from the blank condition which is an almost completely flattened condition, as shown in FIG. 3, but with the free edges 19,21 attached together, and the erected condition shown in FIG. 1A-E.

Figure 1A:
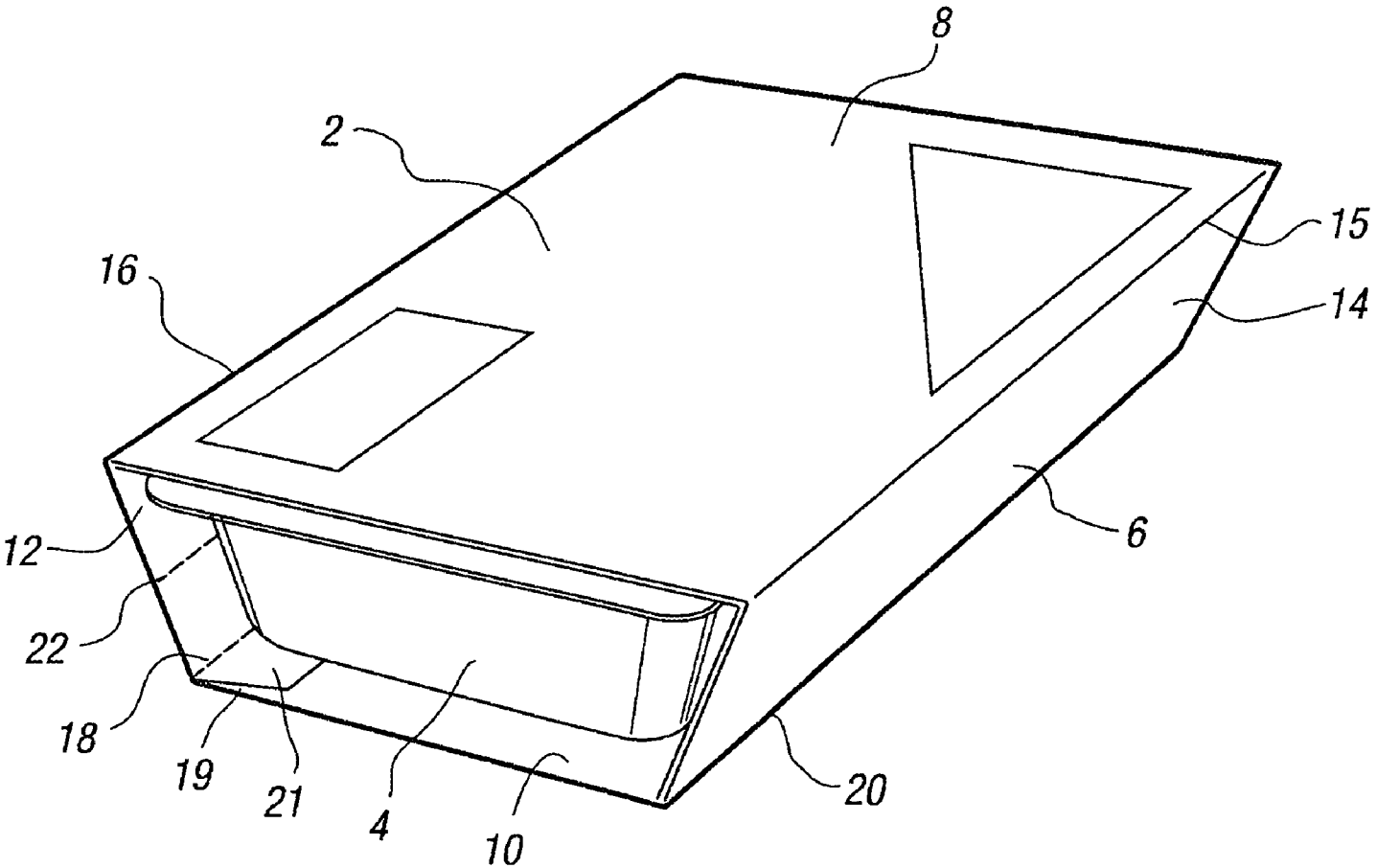
FIG. 1A-E illustrate packages formed in accordance with the invention in perspective in various embodiments.
Figure 1B:
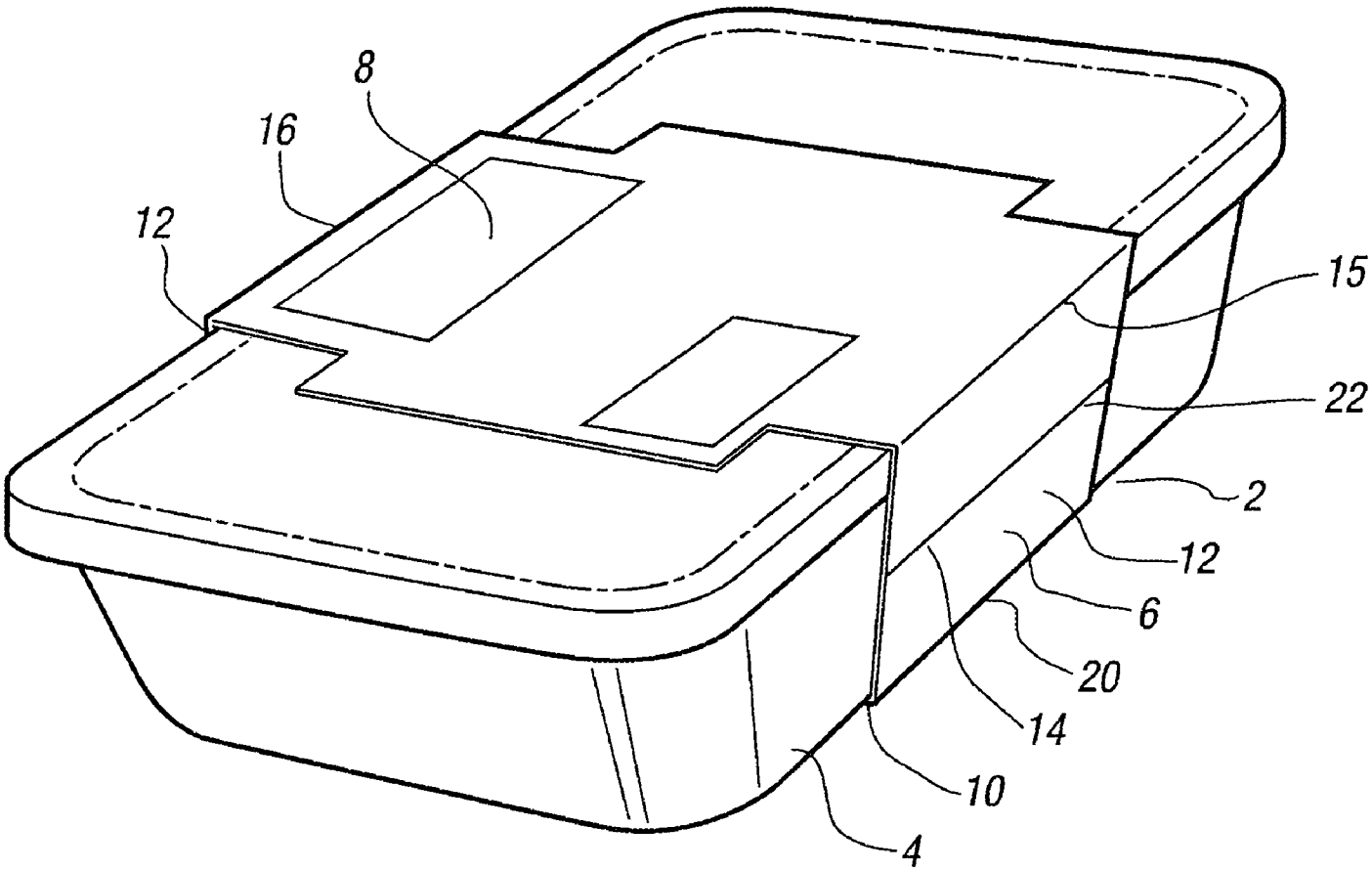
Figures 1C, 1D, 1E:
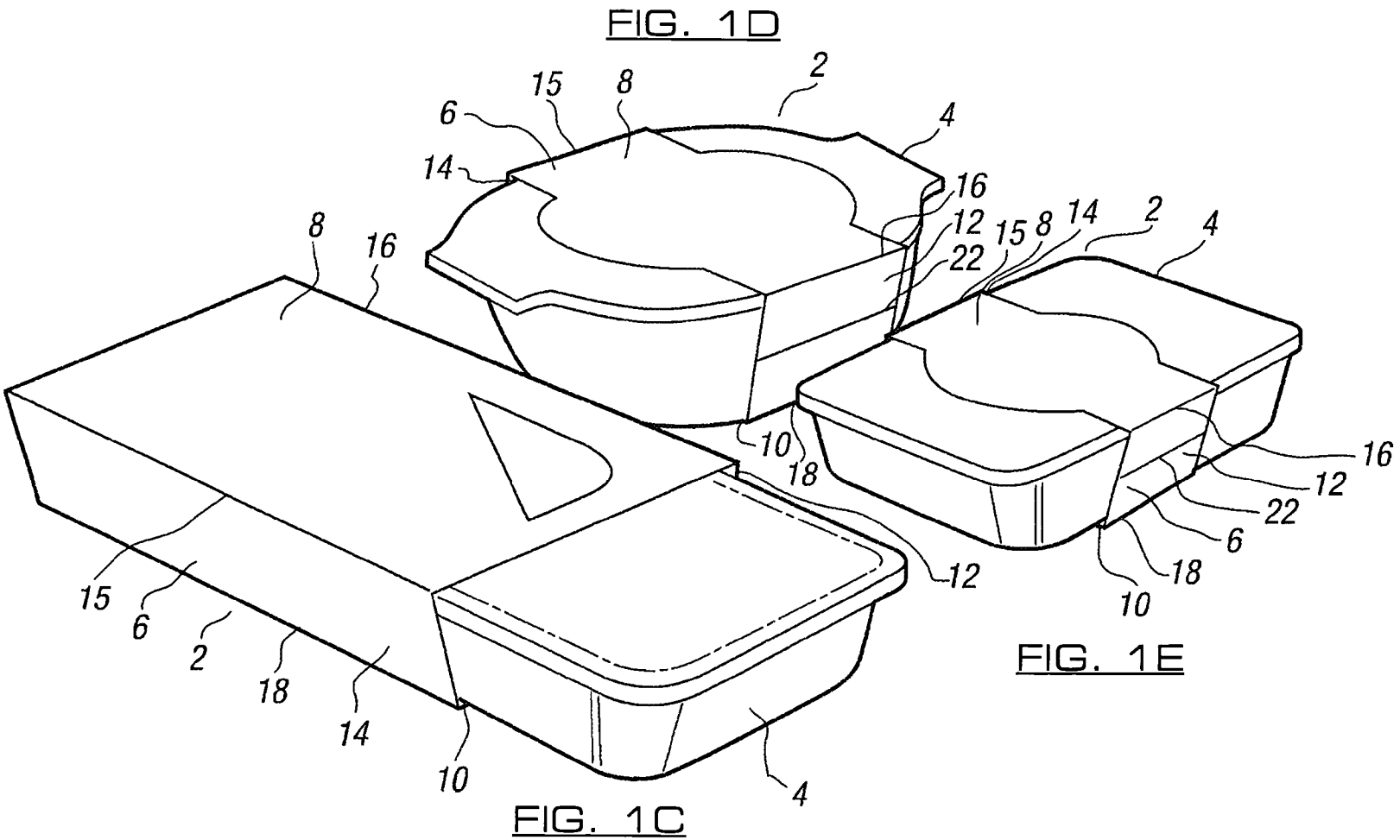

The difference between the packages of FIGS. 1A–E is the different form of the sleeve, with the sleeve design in FIGS. 1B,D,E of the type referred to as a band. Reference herein to a sleeve should be taken as referring to the designs shown and also any other sleeve designs, each of which can be erected and packed utilizing this invention.

The provision of this form of package, typically to allow foodstuffs held in the tray to be purchased and for the foodstuff type to be indicated on the printed material on the sleeve, is well known and the present invention relates to the formation of the packages of this type in an efficient and quick way compared to conventional apparatus and methods.

Figure 2:
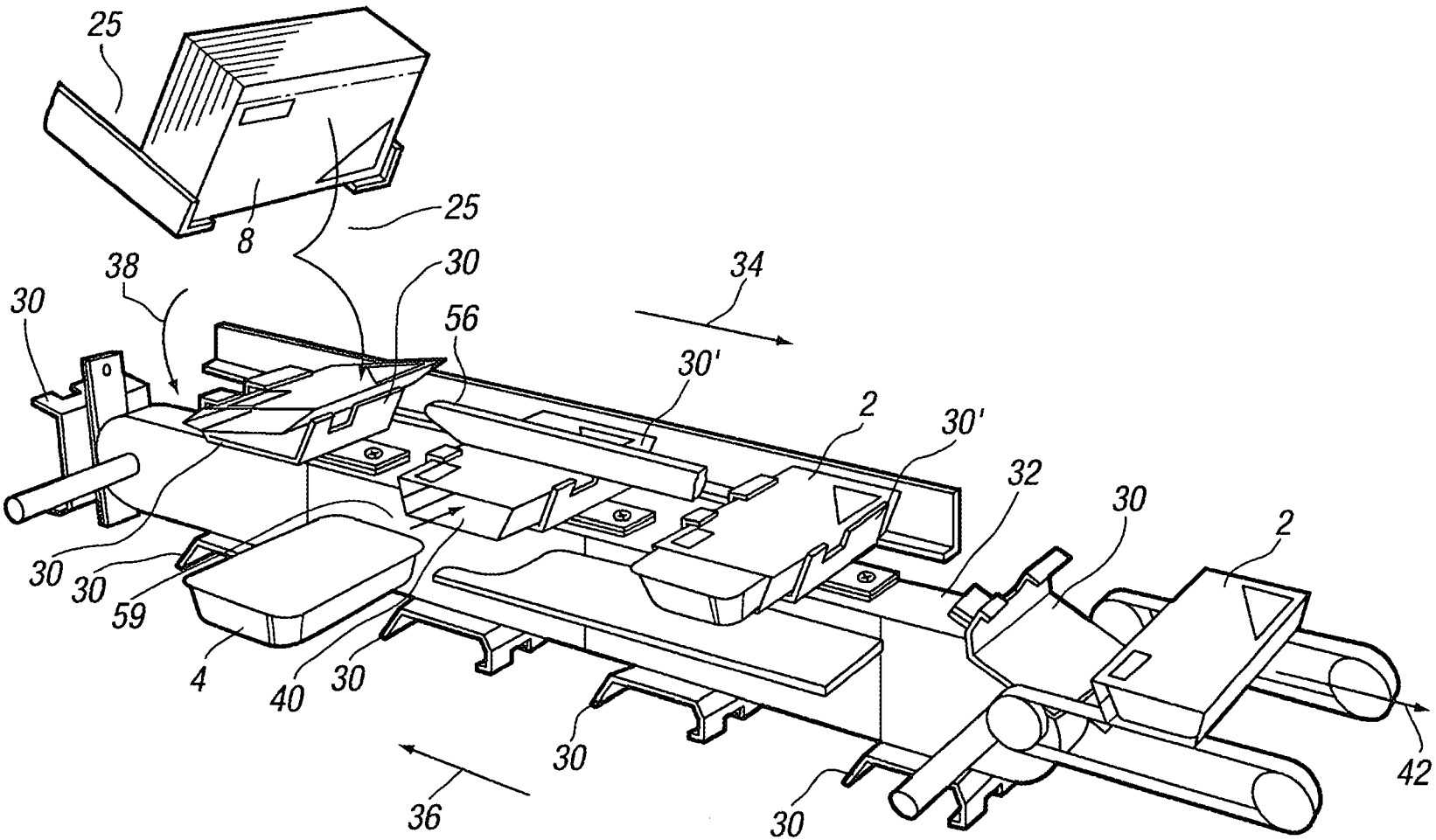
FIG. 2 illustrates apparatus in accordance with the invention.

The apparatus for use in accordance with one embodiment of the invention is illustrated in a schematic manner in FIG. 2. The apparatus comprises a rotatable placement means located with store means 26. The sleeve blanks are moved one at a time from the store means 26 in the direction indicated by arrow 25 by the placement means (not shown). The placement means typically include a suction cup which contacts the surface 8 and then rotates the blank as shown by arrow 25 through typically 240° to be deposited on a forming tool. With the sleeve blanks formed inasmuch that no further gluing is required the same are carried by the placement means in a flat form. A plurality of said forming tools 30 are provided on a drive means 32 which causes the forming tools 30 to move along a forward path as indicated by arrow 34 and then a return path, as indicated by arrow 36, to reach the start position 38 for the reception of a further sleeve blank. The actual erection of the blank in the forming tool is shown in more detail in FIG. 3 and once the sleeve is erected in the forming tool as illustrated in forming tools 30', the tray 4 can be inserted through the opening 40 defined by the side walls 12, 14 and top and bottom faces 8 and 10 so as to be inserted into the sleeve in the erected form and hence form the package.

At the end of the forward path indicated by arrow 34 each package 2 leaves the forming tool 30 as indicated by arrow 42 for subsequent collection and loading for transit to a retail premises.

If the sleeve is relatively narrow, in the form of a band such as in FIGS. 1B, D, E then the machine will erect these bands as with all designs of sleeve as described and as the tray is pushed through the aperture defined by the erected band, it is moved to contact a back stop. The band can be held on two locators in the forming tool to ensure it stays central in the tool as the tray is pushed through. The removal belts then pick up on the tray that is protruding out of the ends of the tool to remove it from the tool.

Turning now to FIG. 3, there is illustrated in schematic fashion a detailed use of the apparatus and forming tool in accordance with the invention to form the erected sleeve 6. The rotatable placement means 24 provides the sleeve blank in the flattened form as indicated, by the reference numeral 44 and guides the sleeve blank which is folded such that the intermediate fold line 22 is the protruding edge of the blank as it moves as indicated by arrow 43. The sleeve blank 44 is then moved in contact with the forming tool as indicated in broken line 6' onto the side wall 46 of the forming tool 30 so that the intermediate fold line 22 contacts the side wall 46 of the forming tool and, as the forming tool is moving in the direction indicated by arrow 34, the movement of the blank into the forming tool combined with the movement of the forming tool itself causes the fold line 16 of the blank to locate under the lip portion 48 of the forming tool and in turn, the fold line 18 in corner 50 of the forming tool and in turn, the bottom face 10 contacts with the base 52 of the forming tool and the side wall 14 of the blank with the side wall 54 of the forming tool by which stage the blank is effectively moved to the erected form as illustrated by broken line 6". Guide means 56 can also be provided to force the sleeve into the forming tool as indicated by arrow 58 to ensure that the erected sleeve retains the position within the forming tool and hence reaches the position indicated in FIG. 2 where the sleeve 6 is erected and held in the forming tool 30 so defines the opening 40 into which the tray 4 can be inserted as indicated by arrow 59.

It should be appreciated that each of these functions are performed as the apparatus continues to move in terms of the rotatable placement means 24 continues to rotate between the store magazine and the forming tool, the drive means 32 continues to move, and the tray feed means as illustrated in FIG. 2, move in sequence in accordance with the movement of the forming tools 30 along the drive means. This ability for continuous movement greatly increases the throughput rate of forming the packages.

Figure 4:
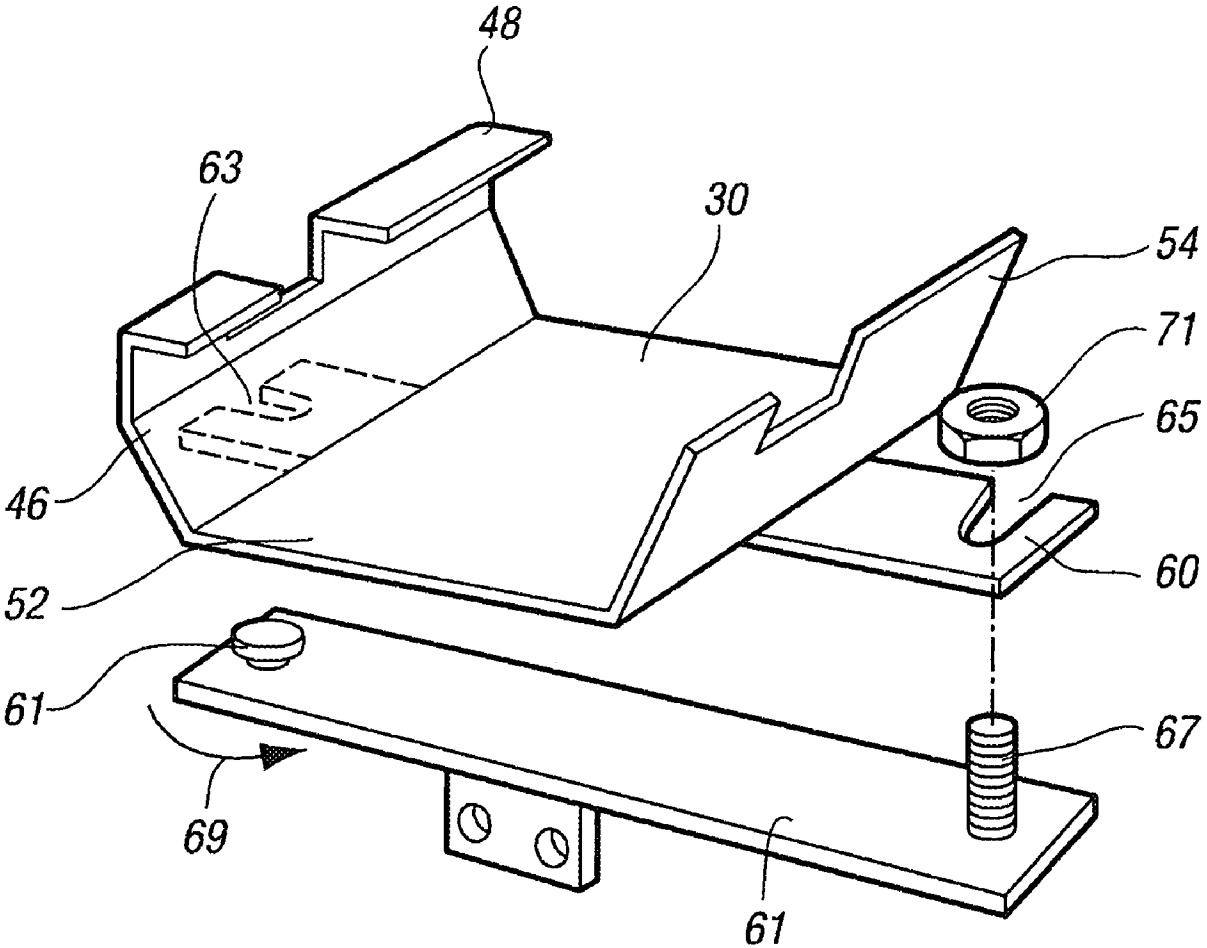
FIG. 4 illustrates the forming tool of the invention in one embodiment.

FIG. 4 illustrates one embodiment of forming tool 30 in more detail wherein the forming tool comprises base portion 52, side walls 46 and 54, with the side wall 46 being provided with a lip portion 48 used as described previously. The forming tool also includes a mounting plate 60 by which the forming tool can be attached to the drive means plate 61 by location means comprising a first slot 63 for location on a first peg 61 and slot 65 for location on peg 67. Typically the forming tool 30 can be positioned by first engaging slot 63 on peg 61 and then rotating the tool as illustrated by arrow 69 about peg 61 to engage slot 65 on peg 67. Typically the peg 67 is threaded to allow the reception of nut 71 to retain the forming tool in position. This therefore means that sets of forming tools can be provided for each design of sleeve to be formed in accordance with the invention with the said sets of forming tools interchangeable with respect to the apparatus and the drive means 32 so that, for example, for a particular production run, the appropriate set of forming tools, with the appropriately formed and angled base 52 and side walls 46, 54, can be fitted to the forming apparatus.

Figure 5A:
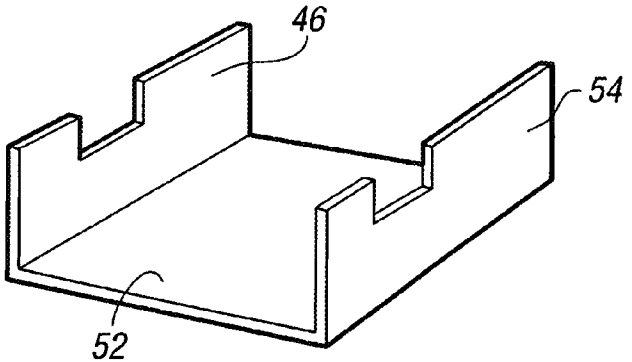
FIGS. 5*a–c* illustrate further forms of the forming tool.
Figure 5B:
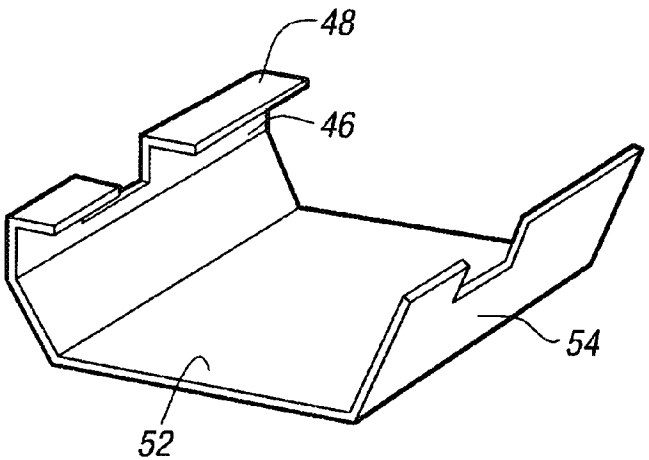
Figure 5C:
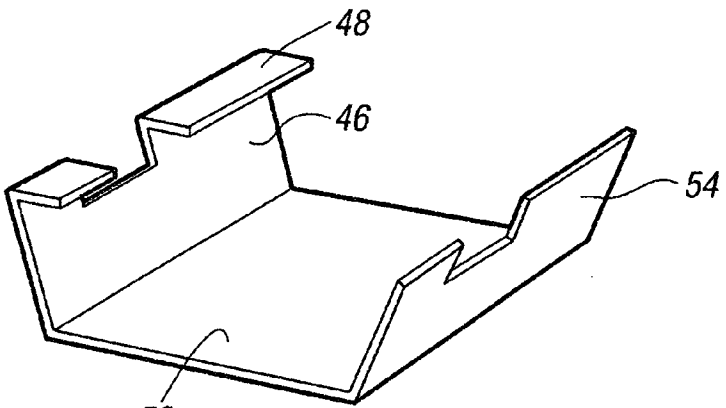

FIGS. 5*a*, *b* and *c* illustrate further embodiments and dimensions of forming tools with alterations to the base 52, side walls 46 and 54 as appropriate to suit particular sleeve designs.

Thus, the invention as herein described allows efficient sleeve erection and package forming in an automated and fast manner. As such the apparatus and method allows commercially beneficial package forming utilising an article in the form of a tray and a sleeve at least partially surrounding the same to be achieved for the first time.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

The invention claimed is:

1. An apparatus for the formation of a package having at least one sleeve having at least top and bottom faces, opposing side walls and being movable between folded and erected conditions and having an intermediate fold line on one of the walls for inserting an article therein; said apparatus comprising:

a drive means for movement along forward and return paths;

a forming tool for holding and forming said at least one sleeve having an intermediate fold line in an erected condition and having a base, an open top and opposing side walls angled to define an erected shape of the packaging sleeve when positioned in the forming tool, one side wall having a lower portion angled to the base, an upper portion perpendicular to the base, and an upper edge lip for locating and limiting movement of one of the side walls of the packaging sleeve as the sleeve is moved into the forming tool, mounting plate for attaching the forming tool to the drive means for movement of the forming tool; and placement means having a drive means to move said at least one sleeve having an intermediate fold line in said folded condition for placement into said forming tool such that the wall of the at least one sleeve having the intermediate fold line thereon contacts the lower angled portion of the one side wall.

2. An apparatus according to claim 1, wherein a plurality of forming tools are located at spaced intervals on said drive means for movement along forward and return paths.

3. An apparatus according to claim 2, wherein the movement of said forming tool and placement means causes said sleeve to be erected as the sleeve is positioned in the forming tool.

4. An apparatus according to claim 3, wherein said movement of said forming tool is in a continuous loop, to repeat the forming operation for the next sleeve inserted therein.

5. An apparatus according to claim 1, wherein said at least one sleeve is held in a store magazine for removal by said placement means to present each sleeve in turn for placement into said forming tool.

6. An apparatus according to claim 1, wherein said drive means for said placement means and said drive means having said forming tool mounted thereon are synchronized.

7. An apparatus according to claim 1, wherein erection fingers are provided to further assist the erection of said at least one sleeve.

8. An apparatus according to claim 7, wherein said fingers make contact with said at least one sleeve prior to said forming tool.

9. An apparatus according to claim 1, wherein removal means are provided to carry a formed package away from said forming tool.

10. An apparatus according to claim 9 wherein said removal means include a belt.

11. An apparatus according to claim 1 wherein said forming tool is removable from said drive means so as to allow replacement with suitably shaped forming tools for particular sleeve designs.

* * * * *